United States Patent [19]

Lizzola et al.

[11] Patent Number: 4,671,516

[45] Date of Patent: Jun. 9, 1987

[54] SENTENCE GAME

[75] Inventors: Claudio Lizzola; Marina Lizzola, both of Kettleby, Canada

[73] Assignee: 501 Maxigames Corporation, Kettleby, Canada

[21] Appl. No.: 793,158

[22] Filed: Oct. 31, 1985

[51] Int. Cl.[4] ..... A63F 1/04

[52] U.S. Cl. ..... 273/299; 273/243; 434/172

[58] Field of Search ..... 273/272, 299, 302; 434/172

[56] References Cited

U.S. PATENT DOCUMENTS

| | | | |
|---|---|---|---|
| 2,520,649 | 8/1950 | Northrop | 273/272 |
| 3,116,927 | 1/1964 | Kuhlman | 273/272 |
| 3,191,938 | 6/1965 | Smith | 273/272 |
| 3,389,480 | 6/1968 | Holland | 273/272 |
| 3,482,333 | 12/1969 | Trager | 273/299 |
| 3,618,231 | 11/1971 | Nason | 273/299 X |
| 4,171,816 | 10/1979 | Hunt | 273/302 X |

FOREIGN PATENT DOCUMENTS

| | | | |
|---|---|---|---|
| 747598 | 4/1956 | United Kingdom | 273/272 |
| 1127038 | 9/1968 | United Kingdom | 273/272 |

OTHER PUBLICATIONS

Cadaco Catalog, 1970, p. 12 relied on.

*Primary Examiner*—Anton O. Oechsle
*Attorney, Agent, or Firm*—Bert J. Lewen; Henry Sternberg

[57] ABSTRACT

A game is disclosed which consists of plurality of cards each bearing indicia thereon representing at least one word and a plurality of rewards. The cards are randomly selected and used to construct complete sentences whose meaning and grammar must be subjectively acceptable by the players. Awards are granted for the acceptable sentences.

4 Claims, 4 Drawing Figures

SENTENCE GAME

This invention relates to games and more particularly to a sentence game.

It is an object of the present invention to provide a novel sentence game which rules have been constructed in such a way to offer to the players social entertainment throughout continuous mutual interaction. Imagination and mental elasticity are the main qualities required to be a successful player. The game does not have any educational content and is not intended to be used as a teaching aid.

Accordingly, the invention provides a game consisting of a plurality of cards each bearing indicia thereon representing at least one word and a plurality of rewards. The cards are randomly selected and used to construct complete sentences whose meaning and grammar must be subjectively acceptable by all of the players. The rewards are granted for the acceptable sentences.

The preferred embodiment of the invention will now be described, by way of illustration only, with reference to the following drawings in which.

Figure 1:
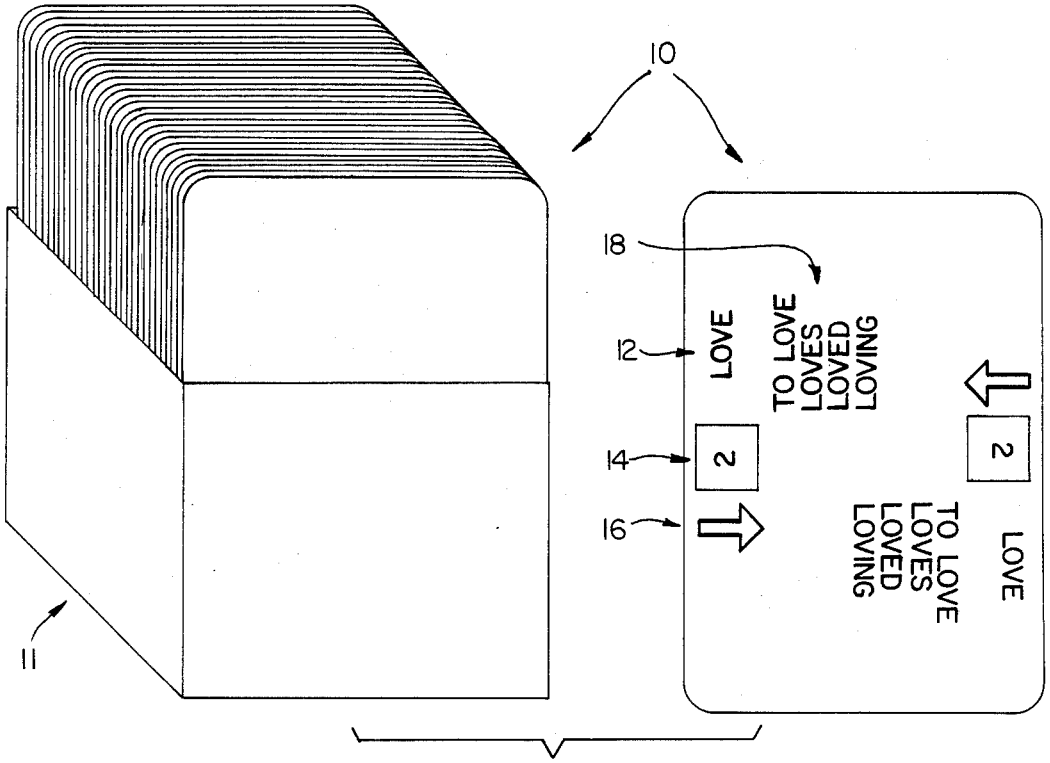
FIG. 1 is a perspective view of playing cards and one specific card to be used with a sentence game.

The elements of the game will now be described with reference to FIGS. 1, 2, and 3. FIG. 1 shows cards 10 in a card box 11 to be used with a sentence game. In the upper right hand corner, each card 10 bears a word 12. In the card shown, the word 12 is "LOVE". Adjacent to this word is a number of points within a box 14. In the card 10 shown the number is "2". Adjacent to the box 14 is an arrow 16. The arrow 16 indicates that in the centre of the card is printed a number of alternative words 18 which are variations (generally inflections of a verb) of the word 12. In the card shown, the alternative words are "TO LOVE", "LOVES", "LOVED", "LOVING". If the arrow 16 is missing, it means that there are no alternative words acceptable to the word 12. However, every word which has a plural form is allowed also in the plural form although there is no specific indication of this on the card itself. Cards 10 bearing words that are repeated on more than one card 10 because of their frequent use in sentences are printed in red and cards bearing words that are not repeated are printed in black. The different colour quickly tells the player whether or not the word in the card is one of the most frequently used words and therefore one of the words needed the most in order to compose a correct and meaningful sentence. Word 12, box 14 and arrow 16 are printed twice on the card 10 so that, regardless of how the player handles the card, they will be visible in the upper right corner. Similarly, the alternative words 18 are printed twice in the centre of the card. In the sentence game there are five hundred cards 10 with three hundred and ninety-nine different words and ten wild cards which can be used to represent any word. Wild cards are printed in gold and, they bear the numeral five in their boxes 14.

Figure 2:
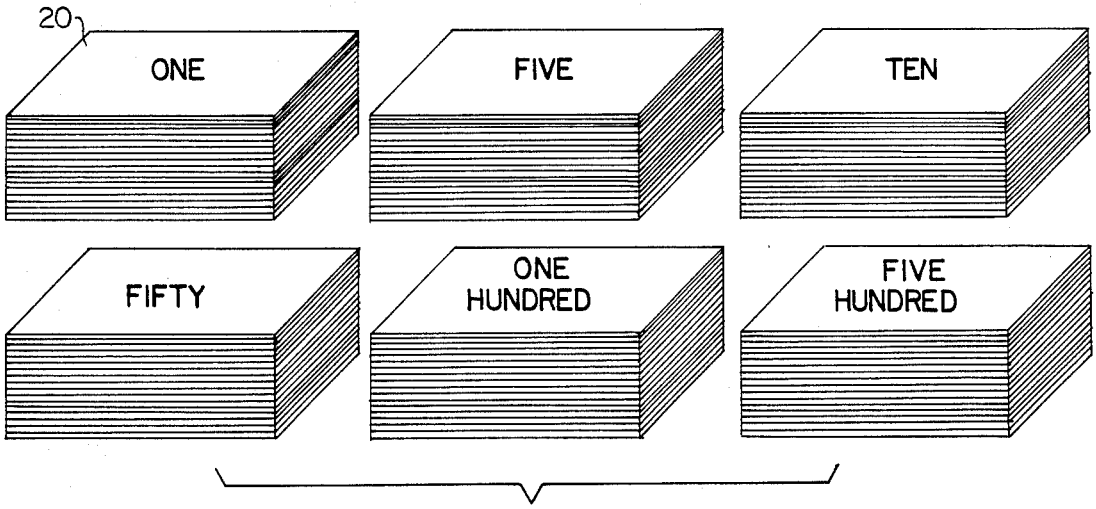
FIG. 2 is a perspective view of chips to be used along with the cards of FIG. 1 in the sentence game.
Figure 3:
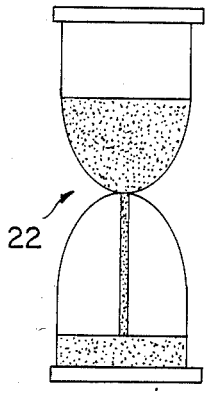
FIG. 3 is a side view of a timer to be used with the chips of FIG. 2 and the cards of FIG. 1 in the sentence game.

FIG. 2 shows chips 20 to be used with the cards of FIG. 1. There are six sets of chips 20, each chip of each set bearing the denomination of that set. The denominations are 1, 5, 10, 50, 100 and 500. The denomination can either be indicated by numbers on the chips, by colour, by design, or by a combination thereof. FIG. 3 shows a conventional minute hourglass 22.

The rules of the game are as follows. The game can be played by 2 to 4 players each player may be represented by a team. Each player receives 1,000 points worth of chips 20 and twelve randomly distributed cards 10. One card 10 is left turned up on the table so that the word on the card is showing and the remainder of the cards 10 are returned to the card box 11.

Before commencing the game, the players decide upon one of several alternative ways to end the game and determine a winner. These alternative ways will be discussed later.

After making this decision, the players decide which player will go first. The first player has the option of picking up the turned up card randomly selecting a card 10 from the card box 11. The first player must then try to form a sentence from his cards.

The rules for the types of sentences that will be accepted are as follows. The sentence must have at least one verb and one compliment. For example "BE HONEST" is acceptable, but "NO EXIT" is not. It is permitted to have sentences where the subject is general such as, "OCEANS ARE BLUE", and to have sentences in the imperative mode such as "WATCH THE NASTY ALLIGATOR". Nouns can also be used in the plural form, even though only the singular form is indicated on the card. Verbs can be conjugated to any simple tense. For example if the words on the card is "BE", it can be used in the sentence as "TO BE", "AM", "ARE", "IS", "WAS", "WERE", "BEEN", or "BEING". Every admissible alternative form of the word is indicated in the centre of the card beneath the arrow 16. No noun or verb can be enriched by more than 2 adjectives and/or adverbs.

The timer is set at the beginning of each player's turn, and the player must construct his sentence before the timer has run out.

If he is unable to put together a sentence, the first player must discard one card 10, which is turned up and left on the table. The next player has the option of picking up this card, or randomly selecting a card from the card box.

If the first player is able to put together a sentence, he lays the cards forming the sentence in order down on the table and reads the sentence formed by the cards to the other players. The other players must check that every word in the sentence is correctly used, and must unanimously agree that the sentence is grammatically correct and that the meaning is acceptable. If there is not unanimous acceptance, the first player must withdraw the sentence or, if possible, he can amend the sentence to an acceptable form. The player also has the option of presenting a second sentence for approval. If the second sentence is also not approved and cannot be amended, the turn passes to the next player. If the sentence is approved, the player adds the points indicated in the box 14 on each of the cards 10 forming the sentence to obtain a total and multiplies that sum by the number of cards 10 forming the sentence to obtain a final result. A reference card may be provided to facilitate the calculation. Each of the other players must remit to the first player this amount in chips 20.

For example, if the player put down the sentence "PEOPLE LOVE FLOWERS", and the number three is in the box 14 on the card 10 bearing the word "PEOPLE", the number two is in the box 14 on the card 10 bearing the word "LOVE", and the number two is in the box on the card bearing the word "FLOWER", these numbers are added together to obtain a total of seven. The number seven is then multiplied by the number of cards in the phrase, which is three. The resulting number of points is twenty-one, and the other players must remit twenty-one points worth of chips 20 to the player who put down the sentence. After receiving twenty-one chips 20 from each of the players, the first player must discard one of the cards he has in his hand and place it turned up on the table, and then must randomly select from the box of cards the same number of cards as he put down in his sentence, so that he has twelve cards in his hand.

The subsequent players in turn try to make sentences in the same manner as above. These sentences can be independent of the sentence already put down. After a sentence has been put down on the table, it is possible for subsequent players to add words to this sentence. This must be done without altering the order of the words already in the sentence. The new words can be added at any location in the sentence. The phrase resulting from the insertion of one or more new words does not need to have the same sense as the original phrase, but must be unanimously accepted by the other players.

The points rewarded for adding a word to a sentence are calculated as follows. The points indicated by the new card or cards must be added up to obtain a total, and this total must be multiplied by the number of all the cards in the resulting sentence.

For example, if to the sentence "PEOPLE LOVE FLOWERS" the word "FRESH", the word "AND", and the word "ANIMALS" are added, the sentence may be transformed into "PEOPLE LOVE FRESH FLOWERS AND ANIMALS". If the card bearing the word fresh indicates that this word is worth two points, "ANIMALS" is worth three, and "AND" is worth one, the total will be six. The number of cards in the sentence is six, so the resulting number of points will be six multiplied by six which is thirty-six. The player who originally made the sentence is the only player who must submit chips in this amount to the player who has added one or more words to the sentence. If a player makes additions to one of the sentences he has previously played, all of the other players must submit chips in this amount to the player. During his turn, a player can put down one or more sentences and add words to other players sentences or to his sentences.

If a player uses all of his twelve cards plus the one taken at the beginning of the turn, he is not obliged to discard one card before replacing the twelve original cards.

When there are ten sentences on the table, they are removed from the table and discarded to make room for subsequent sentences.

As was previously mentioned, the players can choose between one of several ways to end the game. The first way is to make each player drop out of the game when he has lost all of his chips. The game ends when only one player has any chips. The second way to end the game is to establish a time period measured using the timer 22 at the end of which the game is over. The player with the most chips at the end of the time period is the winner. The third way is to use a predetermined number of cards. After these cards have all been played, the person with the highest numbers of chips is the winner.

Figure 4:
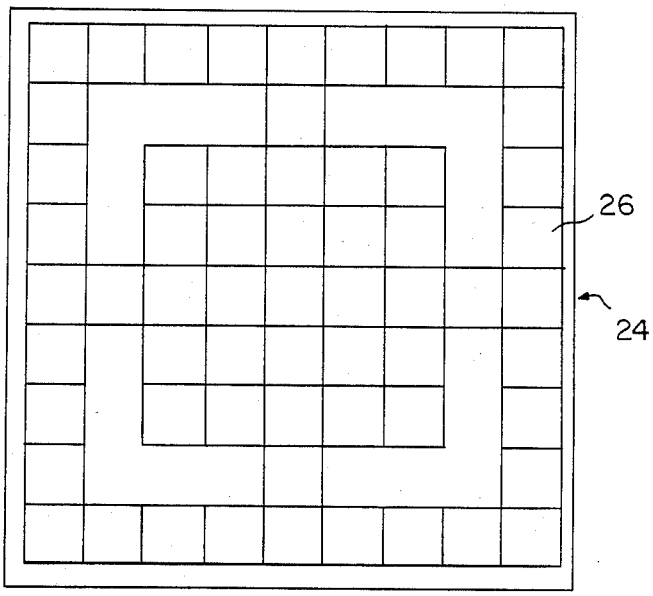
FIG. 4 is a top view of a board to be used with an alternative form of the sentence game.

Another embodiment of the game is shown in FIG. 4 This embodiment includes a board 24 divided into spaces 26. The cards 10 to be used in this embodiment are colour coded and/or divided into groups according to the part of the speech in which they belong (nouns, verbs, adverbs, adjectives, conjunctions, interjections, prepositions, pronouns and articles). The players throw a die or dice and move their respective markers accordingly along the spaces 24 printed on the board. The space on the board on which the marker stops, bears indicia relating to what part of speech card the player is entitled to pick up. In this way the player accumulates cards to build sentences and gain awards.

It is to be appreciated that modifications can be made to the preferred embodiment of the game within the scope of the invention as described and claimed. The colours of the cards can be different. Points may be awarded by writing them on a score sheet rather than by submitting chips. The timer is optional. Sentences may be accepted by the majority of players rather than all of them. The rules may be modified by, for example, not allowing players to amend their sentences if the other players do not accept it. More than four players may be allowed to play. Also, a die or dice, spinning wheel or randomly chosen cards may establish at each player's turn a mandatory feature of the sentence (eg.—length, grammatical construction, subject). Another possibility is that the words could be selected on purpose, rather than randomly, and the sentences made must have a meaning corresponding to a mandatory theme.

We claim:

1. A method of playing a game comprising the steps of:

distributing to players a plurality of variously valued reward tokens;

distributing to players a plurality of cards from a deck of cards, said cards bearing indicia thereon representing at least one word and indicia corresponding to the value of said word;

allowing said players in turn to perform an action selected from forming an original sentence, with the words on said cards, adding words to a player's own existing sentence to form a modified sentence and adding words to an opposing player's existing sentence to form a modified sentence;

wherein upon a player forming an original sentence, the opposing players give to said player an amount of reward tokens proportional to the value and number of words in said sentence, wherein upon a player adding words to said player's own existing sentence to form a modified sentence, the opposing players give to said player an amount of reward tokens proportional to the value of the words added to said existing sentence and the number of words in said modified sentence, wherein upon a player adding words to an opposing player's existing sentence to form a modified sentence, only that opposing player gives to said player an amount of reward tokens proportional to the value of the words added to said existing sentence and the number of words in said modified sentence; and allowing the opposing players to view said sentences to determine subjectively whether or not the sentences are grammatically correct and meaningful prior to awarding reward tokens for said sentences.

2. A method as claimed in claim 1 wherein the reward means to be given for each sentence is computed by adding together each said reward indicia on each of said cards used in said sentence to obtain a total and multiplying said total by the number of cards in said sentence.

3. A method as claimed in claim 1 wherein said reward means for adding a word to a previously formed sentence are computed by multiplying the reward indicia for said extra word by the number of words in said new sentence.

4. A method as claimed in claim 1 wherein all of the players must determine that the sentences are grammatically correct and meaningful before reward means will be distributed.

* * * * *